US006247978B1

(12) United States Patent
Wu

(10) Patent No.: US 6,247,978 B1
(45) Date of Patent: Jun. 19, 2001

(54) ELECTRICAL CONNECTOR WITH A PLURALITY OF UNITARY CONDUCTIVE CLAMPING ELEMENTS, EACH OF WHICH HAS TWO ENDS FOR CLAMPING RESPECTIVELY A CONDUCTOR OF AN ELECTRICAL CABLE AND A TERMINAL PIN

(75) Inventor: Polo Wu, Taipei (TW)

(73) Assignee: Advanced Connecteck Inc., Taipei (TW)

( * ) Notice: Subject to any disclaimer, the term of this patent is extended or adjusted under 35 U.S.C. 154(b) by 0 days.

(21) Appl. No.: 09/487,481

(22) Filed: Jan. 19, 2000

(51) Int. Cl.[7] ..... H01R 4/10; H01R 13/502
(52) U.S. Cl. ..... 439/879; 439/687
(58) Field of Search ..... 439/879, 891, 439/695, 697, 686, 746, 610, 687, 607, 696

(56) References Cited

U.S. PATENT DOCUMENTS 4,764,130 * 8/1988 DiClemente ..... 439/686
4,963,098 * 10/1990 Myer et al. ..... 439/76
5,295,871 * 3/1994 Lapraik et al. ..... 439/746
5,435,757 * 7/1995 Fedder et al. ..... 439/686
5,855,493 * 1/1999 Shelly ..... 439/465

* cited by examiner

*Primary Examiner*—Paula Bradley
*Assistant Examiner*—James Harvey
(74) *Attorney, Agent, or Firm*—Finnegan, Henderson Farabow, Garrett & Dunner, L.L.P.

(57) ABSTRACT

An electrical connector is adapted for electrical connection with a plurality of electrical cables. The electrical connector includes a terminal seat, a positioning seat, and a plurality of clamping elements. The terminal seat includes an insulating body that is made of an insulating material, and a plurality of parallel terminals pins that are secured to the insulating body. Each of the terminal pins has front and rear ends that project respectively from front and rear side surfaces of the terminal seat. The positioning seat is located behind the terminal seat, and is made of an insulating material. A plurality of accommodating holes are formed through the positioning seat. The clamping elements are made of a conductive material, and are confined respectively within the accommodating holes in the positioning seat. Each of the clamping elements has a front end portion for clamping the rear end of a corresponding one of the terminal pins thereon to establish electrical connection between the terminal pins and the cables, and a rear end portion that is adapted to clamp the conductor of a corresponding one of the cables thereon.

4 Claims, 7 Drawing Sheets

ELECTRICAL CONNECTOR WITH A PLURALITY OF UNITARY CONDUCTIVE CLAMPING ELEMENTS, EACH OF WHICH HAS TWO ENDS FOR CLAMPING RESPECTIVELY A CONDUCTOR OF AN ELECTRICAL CABLE AND A TERMINAL PIN

BACKGROUND OF THE INVENTION

1. Field of the Invention

This invention relates to an electrical connector for connecting electrically a plurality of electrical cables to a peripheral equipment, more particularly to an electrical connector with a plurality of clamping elements, each of which has two ends that clamp respectively a conductor of an electrical cable and a terminal pin.

2. Description of the Related Art

Referring to FIG. 1, a conventional electrical connector is shown to include a metal shell 10, an insulating member 11 that is secured within the shell 10, and a plurality of terminal pins 12, which have front end portions that are inserted respectively into accommodating holes 110 in the insulating member 11. Each of the terminal pins 12 is provided with a plastic protective sleeve 13, which covers a welded joint 14 (see FIG. 2) that is formed between the rear end of the terminal pin 12 and a conductor 20 of an electrical cable 2. An insulating rod 15 is formed with a row accommodating holes 150 for extension of the terminal pins 12 therethrough. In assembly, the terminal pins 12 are welded to the conductors 20 of the cables 2, thereby resulting in difficulties during the assembly of the connector. Referring to FIG. 3, the conventional electrical connector further includes a housing unit, which consists of an upper half 12' and a lower half 13. The terminal pins 12 (see FIG. 1) are located between the upper and lower halves 12', 13. Each of the halves 12', 13 has two curved flanges 121, 131, which are inserted into a retaining slot 111 in the insulating member 11. The upper half 12' has two opposite side walls, each of which is pressed to form a projection 122. The lower half 13 has two opposite side walls, each of which is formed with a hole 132. The halves 12', 13 are interconnected by engaging the projections 122 within the holes 132. Although the projections 122 engage the holes 132, the rear end portions of the halves 12', 13 easily separate from each other.

SUMMARY OF THE INVENTION

An object of this invention is to provide an electrical connector, in which the parts can be easily assembled.

Another object of this invention is to provide an electrical connector with a housing unit, which includes upper and lower halves that can be interconnected firmly.

According to this invention, an electrical connector is adapted for electrical connection with a plurality of electrical cables. The electrical connector includes a terminal seat, a positioning seat, and a plurality of clamping elements. The terminal seat includes an insulating body that is made of an insulating material, and a plurality of parallel terminal pins that are secured to the insulating body. Each of the terminal pins has front and rear ends that project respectively from front and rear side surfaces of the terminal seat. The positioning seat is located behind the terminal seat, and is made of an insulating material. A plurality of accommodating holes are formed through the positioning seat. The clamping elements are made of a conductive material, and are confined respectively within the accommodating holes in the positioning seat. Each of the clamping elements has a front end portion for clamping the rear end of a corresponding one of the terminal pins thereon to establish electrical connection between the terminal pins and the cables, and a rear end portion that is adapted to clamp the conductor of a corresponding one of the cables thereon.

Preferably, the electrical connector further includes a housing unit, which has an upper half and a lower half that is connected removably to the upper half. Each of the upper and lower halves is made of metal, and has two opposite sides, each of which is formed with an abutment plate unit. The abutment plate units are parallel to each other. The abutment plate units of the upper half abut respectively against the abutment plate units of the lower half, and are coupled with the same by a first tongue and-groove engagement unit. The abutment plate units of the housing unit are connected removably to the positioning seat by a second tongue-and-groove engagement unit. A third tongue-and-groove engagement unit connects the housing unit removably to the terminal seat.

BRIEF DESCRIPTION OF THE DRAWINGS

These and other features and advantages of the invention will become apparent in the following detailed description of a preferred embodiment, with reference to the accompanying drawings, in which.

DETAILED DESCRIPTION OF THE PREFERRED EMBODIMENT

Figure 1:
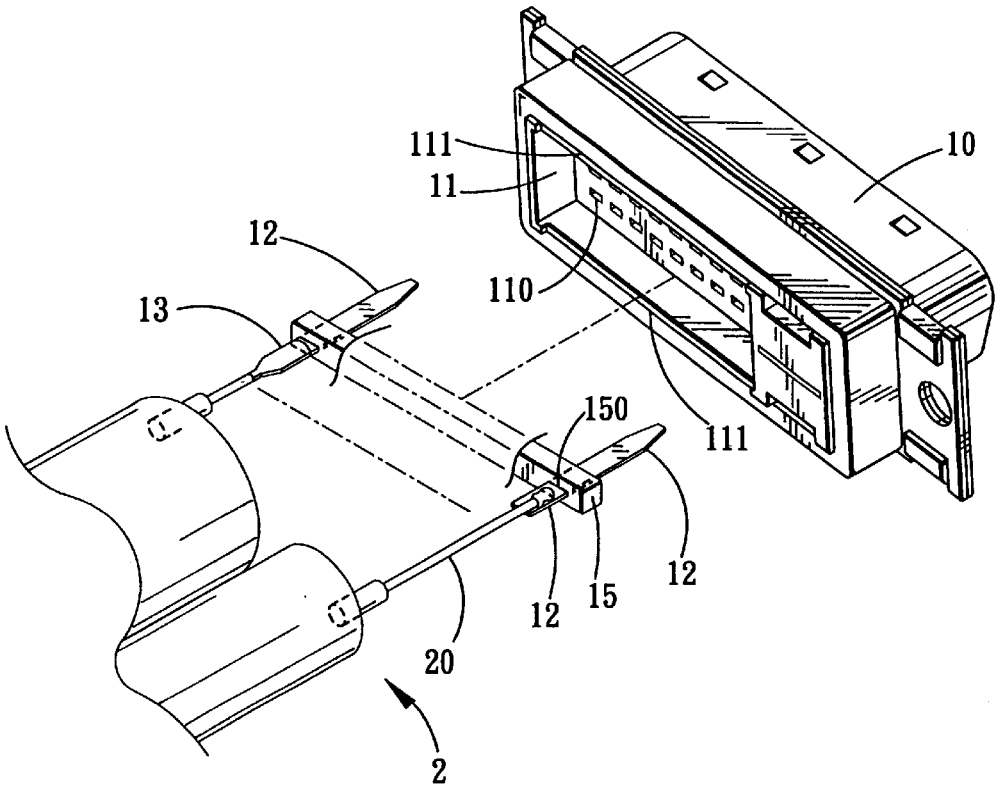
FIG. 1 PRIOR ART
FIG. 1 is a partly exploded view of a conventional electrical connector, in which an insulating sleeve is not shown for the sake of clarity.
Figure 2:
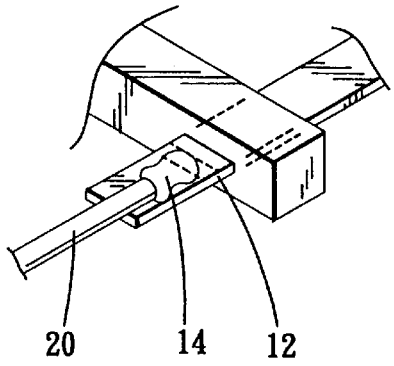
FIG. 2 PRIOR ART
FIG. 2 is a schematic perspective view illustrating how a terminal pin of the conventional electrical connector is welded to a conductor of an electrical cable.
Figure 3:
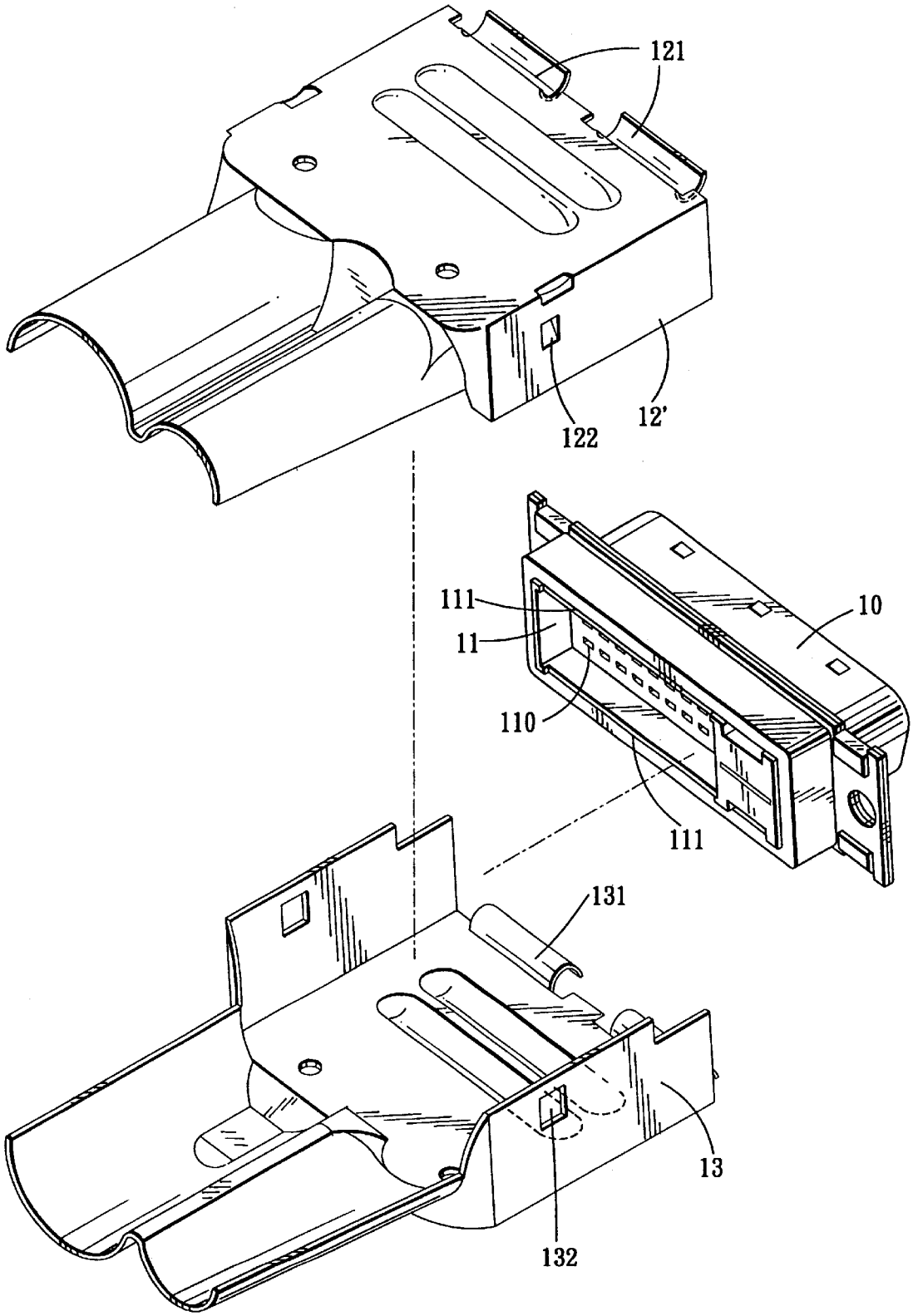
FIG. 3 PRIOR ART
FIG. 3 is an exploded perspective view of a housing unit and a terminal seat of the conventional electrical connector.
Figure 4:
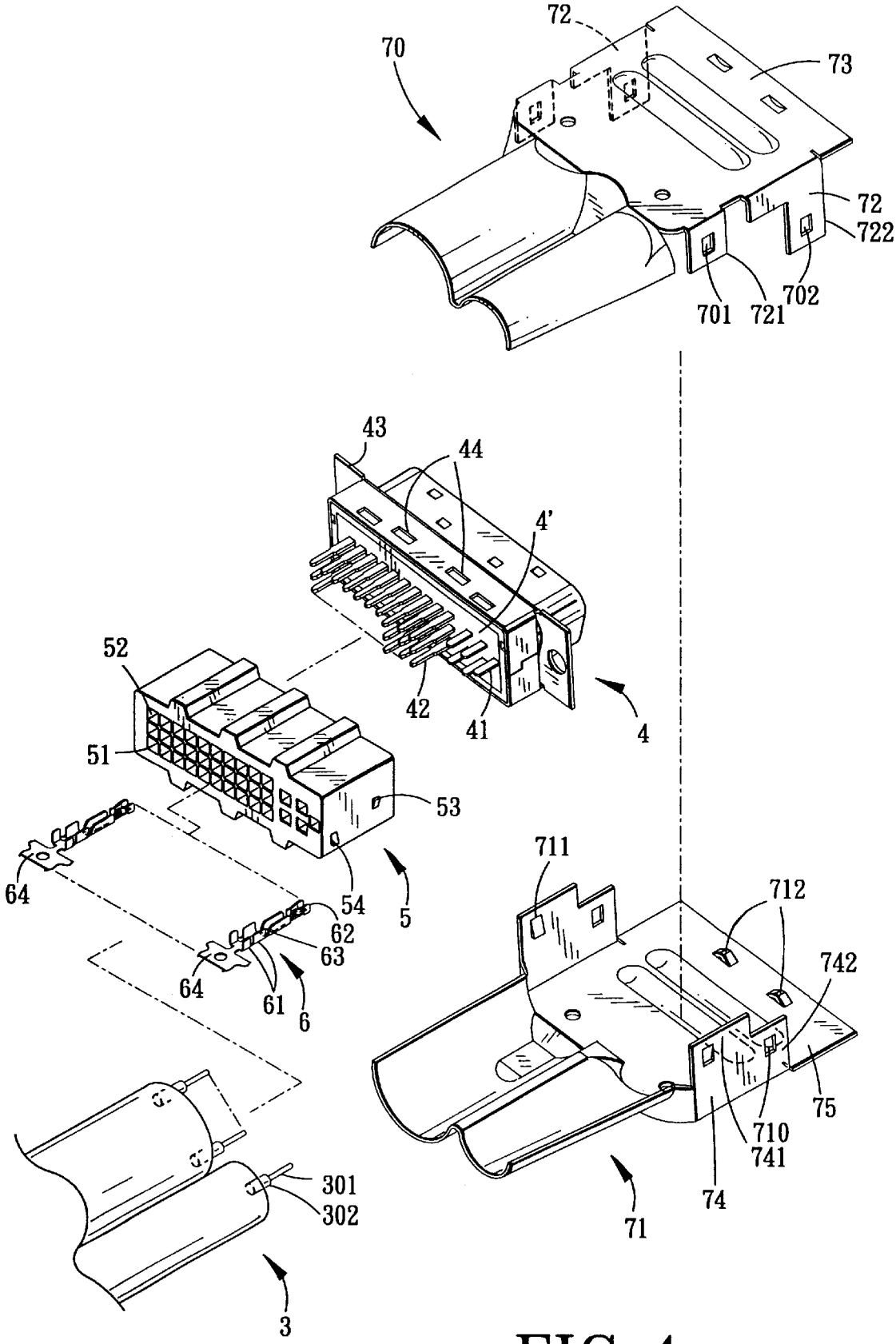
FIG. 4 is an exploded perspective view of a preferred embodiment of an electrical connector according to this invention, in which a plurality of clamping elements are formed integrally with a connecting strip that will be cut to separate from the clamping elements during the assembly of the electrical connector.

Referring to FIG. 4 the preferred embodiment of an electrical connector according to this invention is shown to include a terminal seat 4, a positioning seat 5, a plurality of elongated clamping elements 6, and a housing unit that consists of an upper half 70 and a lower half 71. The connector is adapted to connect electrically with a plurality of electrical cables 3, each of which includes a conductor 301 and an insulating sheath 302.

Figure 5:
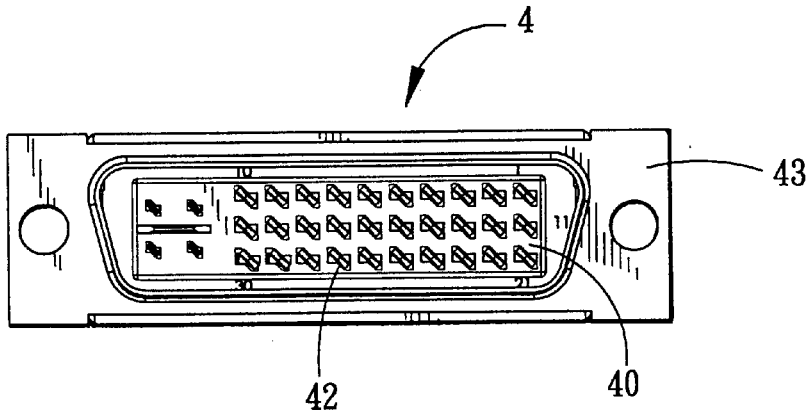
FIG. 5 is a front view of a terminal seat of the preferred embodiment.

The terminal seat 4 includes an insulating body 4' that is made of an insulating material and that has a front side surface 40 (see FIG. 5) and a rear side surface 41, and a plurality of parallel terminal pins 42 that are secured to the insulating body 4'. Each of the terminal pins 42 has front and rear ends that project respectively from the front and rear side surfaces 40, 41 of the terminal seat 4, as shown in FIGS. 4 and 5. The insulating body 4' is fixed within a metal housing 43, which has a plurality of openings to form a plurality of positioning holes 44 in two opposite side surfaces (only one is shown) of the terminal seat 4.

Figure 6:
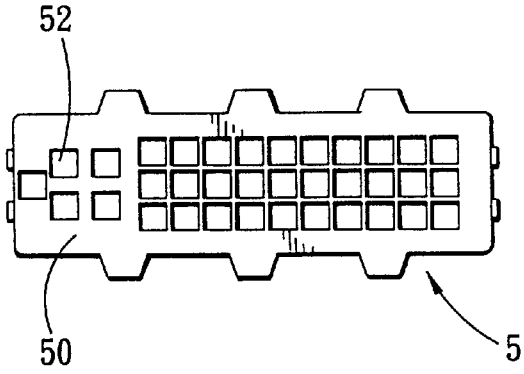
FIG. 6 is a front view of a positioning seat of the preferred embodiment.

The positioning seat 5 is located behind the terminal seat 4, and is made of an insulating material. Each of a plurality of accommodating holes 52 is formed through the positioning seat 5, and has a front end that opens in a front side surface 50 (see FIG. 6) of the positioning seat 5, and a rear end that opens-in a rear side surface 51 of the positioning seat 5.

The clamping elements 6 are made of a conductive material, and are disposed respectively within the accommodating holes 52 in the positioning seat 5. In this embodiment, each of the clamping elements 6 is made of metal, and has two conductor-clamping sheets 61 on a rear end portion thereof, which are adapted to clamp the conductor 301 of a corresponding one of the cables 3 therebetween, and two terminal-clamping sheets 62 on a front end portion thereof for clamping the rear end of a corresponding one of the terminal pins 42 therebetween. As such, electrical connection can be established between the terminal pins 42 and the cables 3.

Figure 9:
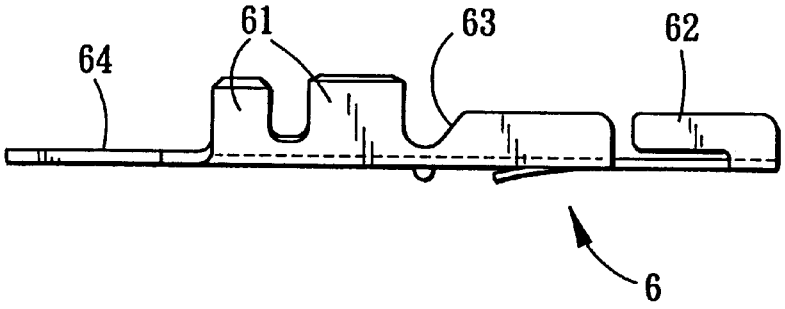
FIG. 9 is a side view of the clamping element of the preferred embodiment.

Each of the clamping elements 6 further has a groove unit 63 (see FIGS. 9 and 10), which is formed between the conductor-clamping sheets 61 and the terminal-clamping sheets 62. The positioning seat 5 includes a plurality of integral tongues 520 (see FIGS. 7 and 10), which are formed respectively in the accommodating holes 52 and which engage respectively the groove units 63 in the clamping elements 6, thereby confining the clamping elements 6 within the accommodating holes 52 in the positioning seat 5.

Figure 7:
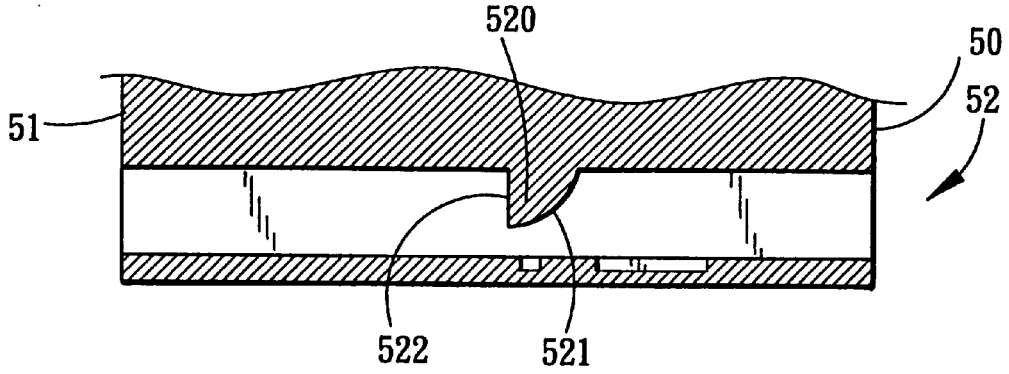
FIG. 7 is a schematic sectional view illustrating how a tongue is formed on the positioning seat of the preferred embodiment.
Figure 8:
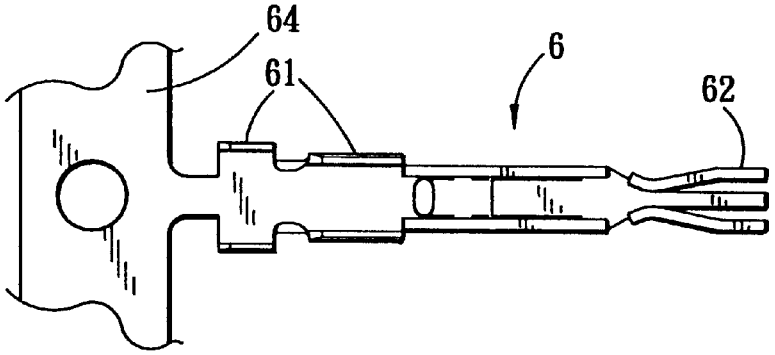
FIG. 8 is a top view of a clamping element of the preferred embodiment.
Figure 10:
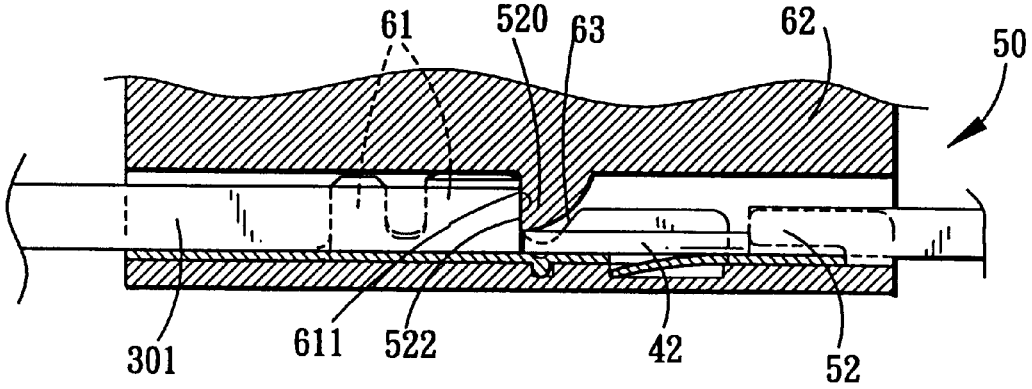
FIG. 10 illustrates how the clamping element is retained on the positioning seat of the preferred embodiment.
Figure 11:
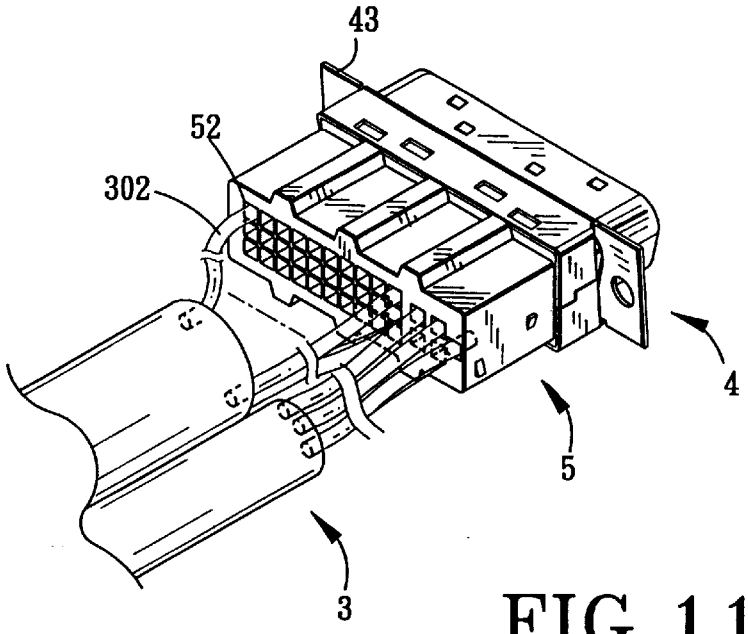
FIG. 11 is an assembled perspective view of the preferred embodiment, in which a housing unit is removed for the sake of clarity.
Figure 12:
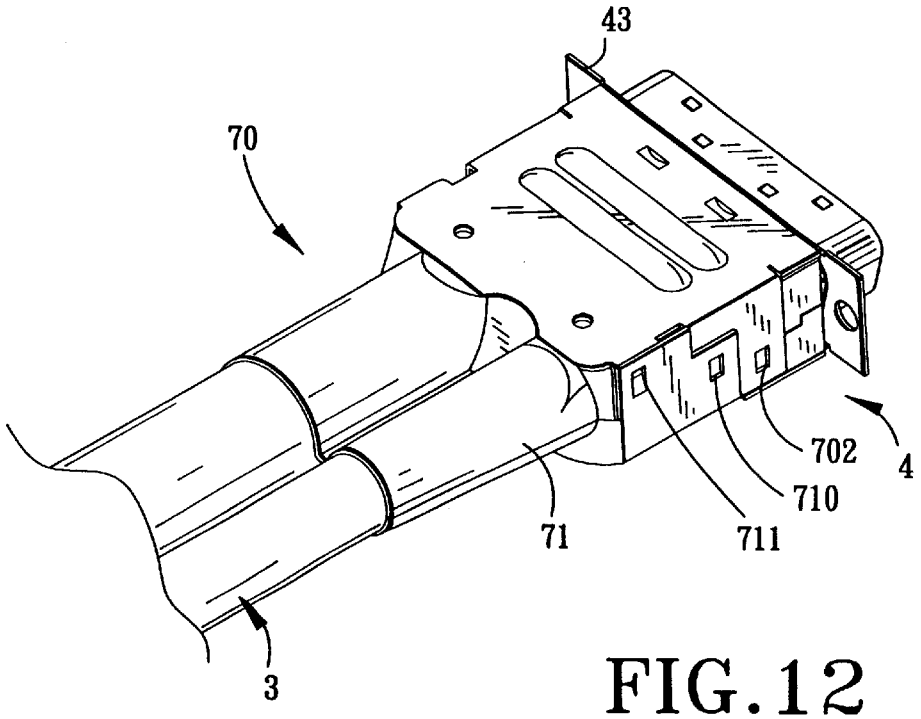
FIG. 12 is an assembled perspective view of the preferred embodiment.

Each of the tongues 520 has a curved front surface 521 (see FIG. 7) and a flat rear end surface 522 (see FIGS. 7 and 10). Each of the clamping elements 6 has a flat front end surface 611 (see FIG. 10) that is located immediately behind the flat rear end surface 522 (see FIGS. 7 and 10) of a corresponding one of the tongues 520 for preventing forward movement of the clamping elements 6 in the accommodating holes 52 in the positioning seat 5. The tongues 520 and the groove units 63 are shaped so as to permit rearward movement of the clamping elements 6 in the accommodating holes 52 in the positioning seat 5. The clamping elements 6 are formed integrally with a connecting strip 64, which is cut to separate therefrom during the assembly of the electrical connector.

The upper half 70 of the housing unit is unitary, and has two aligned abutment plate units 72 and a cover plate 73 that is perpendicular to the abutment plate units 72. The lower half 71 of the housing unit is unitary, and has two aligned abutment plate units 74 and a cover plate 75 that is perpendicular to the abutment plate units 74.

A first tongue-and-groove engagement unit includes two first positioning holes 701 that are formed respectively in rear portions 721 of the abutment plate units 72 of the upper half 70, and two first projections 711 that are formed on the inner surfaces of rear portions 741 of the abutment plate units 74 of the lower half 71 and that engage respectively the first positioning holes 701. Accordingly, the upper and lower halves 70, 71 are interconnected removably.

A second tongue-and-groove engagement unit includes four second positioning holes 702, 710 that are formed respectively in front portions 722, 742 of the abutment plate units 72, 74 of the upper and lower halves 70, 71, and four second projections 53, 54 that are formed on two opposite side surfaces of the positioning seat 5 and that engage respectively the second positioning holes 702, 710. Accordingly, the upper and lower halves 70, 71 are connected removably to the positioning seat S.

A third tongue-and-groove engagement unit includes the third positioning holes 44 in the terminal seat 4, and a plurality of third projections 712 that are formed on the inner surface of the cover plates 73, 75 of the upper and lower halves 70, 71 and that engage respectively the third positioning holes 44 in the terminal seat 4. Accordingly, the upper and lower halves 70, 71 are connected removably to the terminal seat 4.

With this invention thus explained, it is apparent that numerous modifications and variations can be made without departing from the spirit and scope of this invention. It is therefore intended that this invention be limited only as indicated by the appended claims.

I claim:

1. An electrical connector adapted for electrical connection with a plurality of electrical cables, each of said cables having a conductor, said electrical connector comprising:

a terminal seat including an insulating body that is made of an insulating material, and a plurality of parallel terminal pins that are secured to said insulating body, said insulating body having a front side surface and a rear side surface, each of said terminal pins having front and rear ends that project respectively from said front and rear side surfaces of said terminal seat;

a positioning seat located behind said terminal seat and made of an insulating material, said positioning seat having a front side surface, a rear side surface, and a plurality of accommodating holes that are formed through said positioning seat, each of said accommodating holes having front and rear ends that open respectively in said front and rear side surfaces of said positioning seat; and a plurality of elongated parallel clamping elements made of a conductive material and confined respectively within said accommodating holes in said positioning seat, each of said clamping elements having a front end portion for clamping said rear end of a corresponding one of said terminal pins thereon, and a rear end portion that is adapted to clamp the conductor of a corresponding one of the cables thereon to establish electrical connection between said terminal pins and the cables, said electrical connector further comprising:

a housing unit including an upper half and a lower half;

a first tongue-and-groove engagement unit for interconnecting said upper and lower halves removably;

a second tongue-and-groove engagement unit for connecting said housing unit removably to said positioning seat; and a third tongue-and-groove engagement unit for connecting said housing unit removably to said terminal seat.

2. An electrical connector as claimed in claim 1, wherein said first tongue-and-groove engagement unit includes a plurality of first positioning holes that are formed in one of said upper and lower halves, and a plurality of first projections that are formed on the other one of said upper and lower halves, said second tongue-and-groove engagement unit including a plurality of second positioning holes that are formed in one of said positioning seat and said housing unit, and a plurality of second projections that are formed on the other one of said positioning seat and said housing unit for engaging respectively said second positioning holes to position said housing unit relative to said positioning seat, said third tongue-and groove engagement unit including a plurality of third positioning holes that are formed in one of said terminal seat and said housing unit, and a plurality of third projections that are formed on the other one of said terminal seat and said housing unit for engaging respectively said third positioning holes.

3. An electrical connector as claimed in claim 2, wherein each of said upper and lower halves is made of metal, and has two opposite sides, each of which is formed with an abutment plate unit, said abutment plate units being parallel to each other, said abutment plate units of said upper half abutting respectively against said abutment plate units of said lower half, each of said abutment plate units having a front portion that is formed with one of said second positioning holes, and a rear portion that is formed with one of said first positioning holes and said first projections, said positioning seat having two opposite side surfaces, each of which is formed with two of said second projections that are arranged one behind the other, said terminal seat having two opposite side surfaces that are formed with said third positioning holes, each of said upper and lower halves having a cover plate, which is perpendicular to said abutment plate units and which is pressed to form several of said third projections that extend respectively and inwardly from said abutment plate units, whereby, said upper and lower halves of said housing unit are positioned on said terminal seat and said positioning seat.

4. An electrical connector adapted for electrical connection with a plurality of electrical cables, each of said cables having a conductor, said electrical connector comprising:

a terminal seat including an insulating body that is made of an insulating material, and a plurality of parallel terminal pins that are secured to said insulating body, said insulating body having a front side surface and a rear side surface, each of said terminal pins having front and rear ends that project respectively from said front and rear side surfaces of said terminal seat;

a positioning seat located behind said terminal seat and made of an insulating material, said positioning seat having a front side surface, a rear side surface, and a plurality of accommodating holes that are formed through said positioning seat, each of said accommodating holes having front and rear ends that open respectively in said front and rear side surfaces of said positioning seat; and a plurality of elongated parallel clamping elements made of a conductive material and confined respectively within said accommodating holes in said positioning seat, each of said clamping elements having a front end portion for clamping said rear end of a corresponding one of said terminal pins thereon, and a rear end portion that is adapted to clamp the conductor of a corresponding one of the cables thereon to establish electrical connection between said terminal pins and the cables, wherein each of said clamping elements is made of metal, and has two terminal-clamping sheets on said front end portion thereof for clamping said rear end of the corresponding one of said terminal pins therebetween, and two conductor-clamping sheets on said rear end portion thereof, which are adapted to clamp the conductor of a corresponding one of the cables therebetween, wherein each of said clamping elements has a groove unit that is formed therein, said positioning seat including a plurality of integral tongues that are formed respectively in said accommodating holes and that engage respectively said groove units in said clamping elements, thereby confining said clamping elements within said accommodating holes in said positioning seat and wherein each of said tongues is tapered, and has a curved front surface and a flat rear end surface, each of said clamping elements having a flat front end surface that is located immediately behind said flat rear end surface of a corresponding one of said tongues for preventing forward movement of said clamping elements in said accommodating holes in said positioning seat, said tongues and said groove units being shaped so as to permit rearward movement of said clamping elements in said accommodating holes in said positioning seat.

* * * * *